United States Patent [19]

Mayama et al.

[11] Patent Number: 4,794,693

[45] Date of Patent: Jan. 3, 1989

[54] SLIDER FOR A CUTTER KNIFE

[75] Inventors: Tatsushige Mayama; Masanobu Ihata; Yoshihiko Yoshimoto, all of Osaka, Japan

[73] Assignee: Nippon Tenshashi Kabushiki Kaisha, Osaka, Japan

[21] Appl. No.: 79,079

[22] Filed: Jul. 29, 1987

[51] Int. Cl.[4] ..... B26B 1/08

[52] U.S. Cl. ..... 30/162; 30/320; 30/335

[58] Field of Search ..... 30/162, 320, 335, 337, 30/339

[56] References Cited

U.S. PATENT DOCUMENTS

| | | | |
|---|---|---|---|
| 4,170,062 | 10/1979 | Machida | 30/320 X |
| 4,322,885 | 4/1982 | Osada | 30/320 X |
| 4,601,103 | 7/1986 | Sugiyama | 30/162 |

FOREIGN PATENT DOCUMENTS

| | | | |
|---|---|---|---|
| 58-136075 | 9/1983 | Japan . | |
| 1522454 | 8/1978 | United Kingdom | 30/320 |

*Primary Examiner*—Frank T. Yost
*Assistant Examiner*—Michael D. Folkerts
*Attorney, Agent, or Firm*—Griffin, Branigan, & Butler

[57] ABSTRACT

A slider for a cutter knife comprises a slider main body (1) having a protrusion (6) for engaging a cutter blade (40), the blade and slider main body then being inserted into a holder (30) for longitudinal movement therein. A resilient stopper (3) is provided in the slider main body and includes forwardly and backwardly slanted resilient flaps (16,17) whose respective free ends engage two spaced-apart stopper dents (33) formed in the holder. A slider knob (4) is provided on the main body and is movable with respect to the main body to assume a neutral, forward movement, or backward movement position. A release protrusion (5) attached to the slider knob allows both flaps to engage stopper dents when the slider knob is in the neutral position. The release protrusion disengages one or the other of the resilient flaps from the stopper dents when the slider knob is moved to the forward or backward movement position.

19 Claims, 4 Drawing Sheets

SLIDER FOR A CUTTER KNIFE

BACKGROUND OF THE INVENTION

The present invention relates to a slider for a cutter knife, and more particularly, to improvements in an autolock slider applicable to a stepwise sliding type cutter knife.

Japanese Patent Publication Open to Public Inspection No. 58-136075 discloses a slider for a stepwise sliding type cutter knife, the slider comprising a slider main body having a connecting protrusion capable of connecting to a cutter blade and which is inserted together with the cutter blade into a holder thereby permitting longitudinal movement therein. A resliient stopper is provided in the slider main body and is capable of engaging one of a plurality of stopper dents formed in the holder. A slider knob is provided in the slider main body to permit longitudinal movement therein. The slider knob may be set in a neutral position or in forward and backward movement positions between which the neutral position is placed. A restraining protrusion, which is provided in the slider knob, causes the resilient stopper to remain engaged with the stopper dents formed in the holder when the knob is in the neutral position and releases the above-mentioned restraint when the knob is in the forward and rearward movement positions. A spring is provided between the slider main body and the slider knob for forceably maintaining the slider knob in the neutral position. However, the above-mentioned slider had a disadvantage in that the slider has a so-called two-step mechanism wherein the knob is brought into the neutral position by the spring so as to lock the slider against the holder while the restraining protrusion restrains the resilient stopper from moving. Thus, the structure is complicated and reliable functioning cannot be expected without first enhancing the assembly accuracy.

SUMMARY OF THE INVENTION

An object of the present invention is to provide a slider for a cutter knife which is made simple in structure and which functions without the necessity of enhancing the assembly accuracy.

An object of the present invention is to provide a novel resilient stopper and resilient stopper control in a slider of the type having a slider main body provided with a resilient stopper and a slider knob and a release protrusion provided in the slider knob. The slider main body includes a connecting protrusion which can connect to a cutter blade and is inserted together with the cutter blade into a holder thereby permitting longitudinal movement therein. The resilient stopper includes a forwardly slanting resilient flap and a backwardly slanting resilient flap, whose free ends engage each of two separated stopper dents formed in the holder so as to prevent the slider main body from longitudinally moving against the holder. The slider knob is slidable longitudinally in the slider main body and can be set in a neutral position or in a forward or a rearward movement position. The release protrusion, when the slider knob is in the neutral position, allows both resilient flaps of the resilient stopper to engage the stopper dents formed in the holder. When the slider knob is in the forward movement position the release protrusion disengages only the forwardly slanting resilient flap from the stopper dents and, when the slider knob is in the backward movement position the release protrusion disengages only the backwardly slanting resilient flap from the stopper dents.

Other objects of the invention and its mode of operation will become apparent upon consideration of the following description and accompanying drawings.

DETAILED DESCRIPTION OF THE INVENTION

Figure 1:
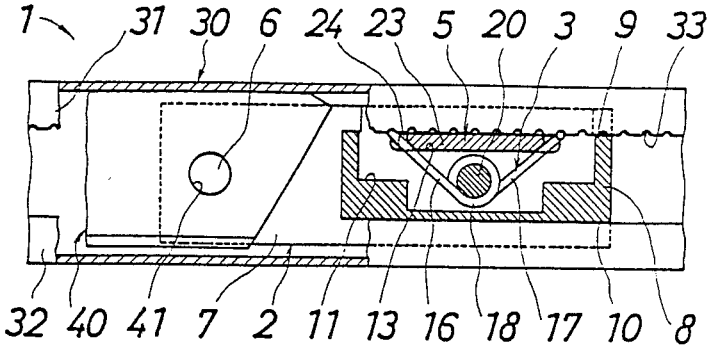
FIG. 1 is a front view, partially in section, of the main portion of a slider and cutter knife constructed according to the present invention.

As illustrated in FIGS. 1–5 and 10, a slider 1 constructed in accordance with the principles of the present invention comprises a slider main body 2, a resilient stopper 3, a slider knob 4 and a release protrusion 5. The slider main body 2 includes a connecting protrusion 6 which engages a hole 41 in a cutter blade 40. The cutter blade and slider main body are inserted from one end into a C-shaped holder 30.

Figure 10:
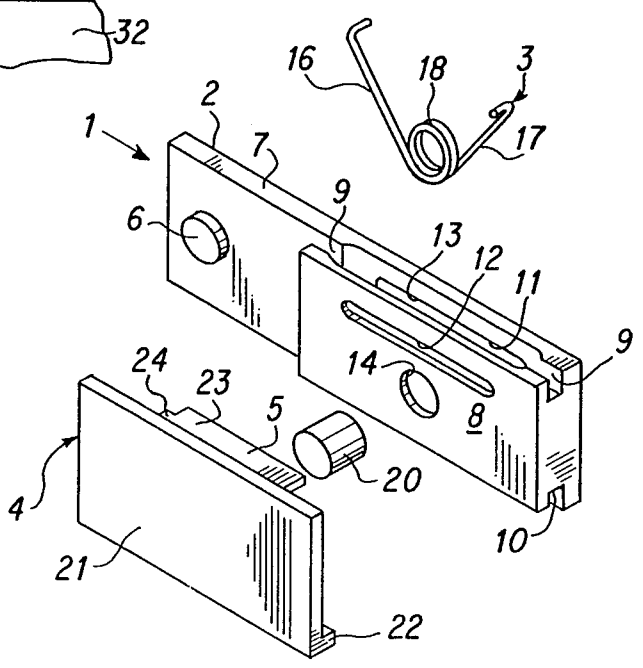
FIG. 10 is an exploded perspective view of the slider shown in FIG. 1.

For purposes of the following description, the front of the slider faces out of the page in FIG. 1. It will be understood that only a portion of cutter blade 40 is shown in FIG. 1, the portion of the blade that is not shown extending to the left in FIG. 1, this being referred to as the forward direction. The slider main body 2 also includes a rectangular base plate 7 from which the connecting protrusion 6 and a projection 8 extend to the front. As best seen in FIG. 10, guide grooves 9 and 10 are cut in the longitudinal direction on the top and bottom of the projection 8 and a cavity 11 is hollowed out from the upper guide groove 9 to the inside of the projection 8. Longitudinally extending oblong holes 12 and 13 are perforated in line with each other in the projection 8 and the base plate 7, respectively. Pin holes 14 and 15 are positioned below these oblong holes and perforated in the projection 8 and the base plate 7, respectively. The slider main body 2 is assembled to holder 30 by inserting its connecting protrusion 6 into the hole 41 in the cutter blade 40 and then inserting the blade and slider main body into the holder. The lower end of the upper front wall 31 of the holder 30 and the upper end of the front wall 32 thereof are respectively received in the upper guide groove 9 and the lower guide groove 10 on the slider main body 2 for allowing the slider 1 to slide longitudinally on the holder 30.

Figure 2:
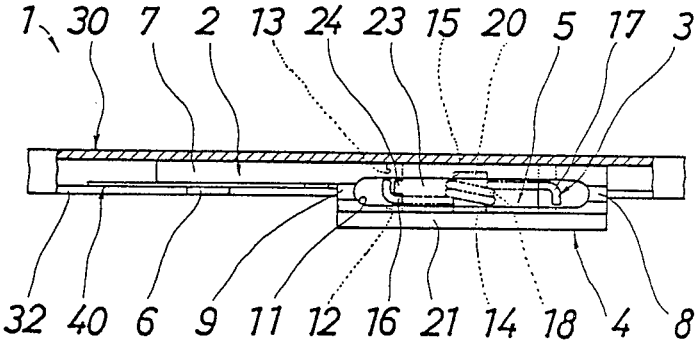
FIG. 2 is a top view of the slider of FIG. 1.
Figure 3:
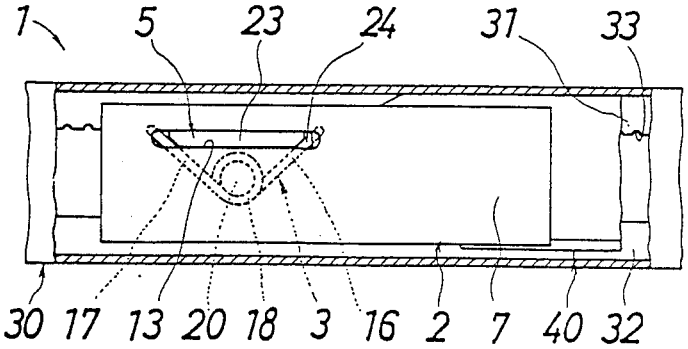
FIG. 3 is a rear view of the slider of FIG. 1.
Figure 4:
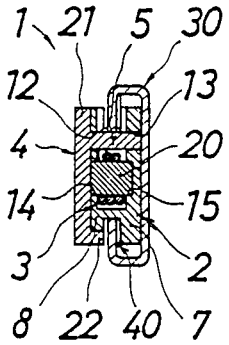
FIG. 4 is a vertical sectional side view of the slider of FIG. 1.

In the embodiment of FIGS. 1–5 and 10, the resilient stopper 3 is made of an approximately V-shaped torsion wire spring having a forwardly slanting resilient flap 16, a backwardly slanting resilient flap 17 and a wound or coiled portion 18 connecting flaps 16 and 17. The free ends of flaps 16 and 17 are bent horizontally to the rear and front, respectively, as shown in FIG. 2. The resilient stopper 3 is installed in the cavity 11 of the slider main body 2 and is fastened therein by inserting a pin 20 into the pin hole 14, the wound portion 18 and pin hole 15.

The free ends of each of the flaps 16 and 17 engage two separated or spaced-apart stopper dents 33 formed at regular intervals on the lower side of the upper front wall 31 of the knife holder 30.

The slider knob 4 is mounted on the slider main body 2 so as to permit longitudinal relative movement with respect to the slider main body to a neutral position, and forward and backward movement positions. The slider knob 4 comprises a plate member 21 having approximately the same size as the projection 8 and a lower wall 22 extending to the rear from the bottom of the plate member 21. The slider knob 4 is superimposed on the front side of the projection 8 to permit longitudinal sliding movement relative thereto. A release protrusion 5 is provided on the slider knob 4 and allows both the resilient flaps 16 and 17 of the resilient stopper to engage with the stopper dents 33 when the slider knob 4 is located in the neutral position. The release protrusion 5 disengages only the forwardly slanting resilient flap 16 from a stopper dent 33 when the slider knob 4 is located in the forward movement position, and disengages only the backwardly slanting resilient flap 17 from a stopper dent when the slider knob is located in the backward movement position.

Figure 11:
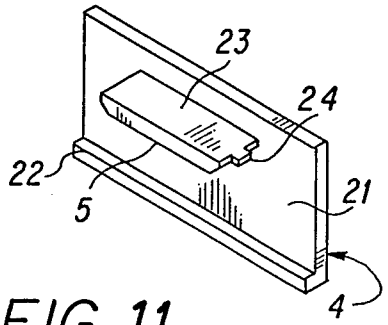
FIG. 11 is a perspective view of one embodiment of a slider knob.

The release protrusion 5 comprises a plate 23, which projects on the rear side of the slider knob 4 and is inserted loosely into the oblong holes 12 and 13 formed in the slider main body 2, and a stopper protrusion 24 (FIG. 11) which protrudes forwardly in the middle of the projecting plate 23. The longitudinal length of the projecting plate 23 is shorter than that of the oblong holes 12 and 13 and is shorter than the distance between the free ends of the forwardly and backwardly slanting resilient flaps 16 and 17 so that the release protrusion 5 can be located between the resilient flaps 16 and 17 as illustrated in FIG. 1. The stopper protrusion 24 on the release protrusion 5 always engages with one portion of the forwardly slanting resilient flap 16 so as to prevent the slider knob 4 from being removed from the slider main body 2.

Since the longitudinal movement of the release protrusion 5 is confined in the oblong holes 12 and 13, the relase protrusion 5, which is attached to the slider knob 4, further serves as a stopper which allows the slider knob 4 to longitudinally move within a limited range in relation to the slider main body 2, thus permitting the slider knob 4 to take the neutral, forward movement or backward movement position.

FIGS. 1–4 illustrate the slider in its detented or autolocked position where it is not movable relative to the holder 30. The slider knob 4 is located in the neutral position and the free end of each of the resilient flaps 16 and 17 engages two separated stopper dents 33 formed in the holder 30. The release protrusion 5 is positioned between the free ends of both the resilient flaps 16 and 17 by their resilience, allowing both the resilient flaps 16 and 17 to engage with the stopper dents 33. Even if a force is applied to the cutter blade 40 to move it forwardly, movement of the slider and blade is prevented because the forwardly slanting resilient flap 16 engages with a stopper dent 33. Conversely, if a force is applied to the cutter blade 40 to move it rearwardly, movement of the slider and blade is prevented because the backwardly slanting resilient flap 17 engages with a stopper dent 33. Therfore, the cutter blade 40 and the slider 1, even when an external force is applied to the blade, are autolocked against the holder 30 and will not move in the longitudinal direction.

Figure 5:
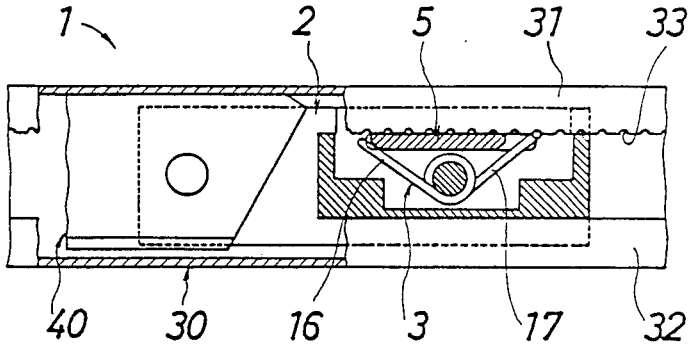
FIG. 5 is a view siilar to FIG. 1 showing forward movement of the slider.

To permit the slider 1 and cutter blade 40 to move forwardly in the holder 30, the slider knob 4 located in the neutral position is forced to move forwardly by applying a force with a thumb. This moves the slider 1 to the forward movement position and, as shown in FIG. 5, the release stopper disengages the forwardly slanting resilient flap 16 from the stopper dents formed in the holder 30. Upon the application of further force the release protrusion 5 touches the forward side of the oblong holes 12 and 13, and the main body 2 and the slider knob 4 both move in the forward direction causing the cutter blade 40 connected to the connecting protrusion 6 to move forwardly. During the forward movement the backwardly slanting resilient flap 17 repeats engagement and disengagement with the stopper dents 33 formed in the holder 30, thereby allowing the slider 1 to move stepwise.

When the thumb is released from the slider knob 4, the slider 1 stops moving forwardly and, as shown in FIG. 1 through FIG. 4, the forwardly slanting resilient flap 16 of the resilient stopper 3 engages with a stopper dent 33. At the same time, resilience of the forwardly slanting resilient flap 16 urges rearwardly the release protrusion 5 rearwardly thus pushing the slider knob 4 attached thereto back to the neutral position.

To permit the slider 1 to move rearwardly relative to holder 30, the slider knob 4 located in the neutral position is forced to move rearwardly by applying a force thereto with the thumb. The slider 1 is brought back to the backward movement position, and the release protrusion 5 disengages the backwardly slanting resilient flap 17 from the stopper dent 33 formed in the holder 30. Upon application of a greater force, the slider knob 4 and the slider main body move rearwardly together by means of the release protrusion 5, allowing the cutter blade 40 to move backwardly. During backward movement the forwardly slanting resilient flap 16 repeats engagement and disengagement with the stopper dents 33 thus allowing the slider 1 to move stepwise.

Figure 6:
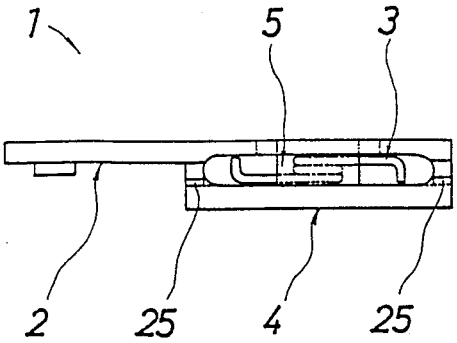
FIG. 6 is a plan view of the slider according to a second embodiment of the invention.
Figure 8:
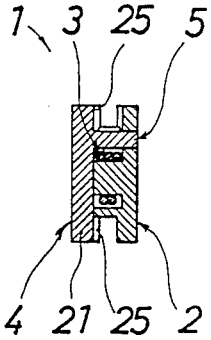
FIG. 8 is a side sectional view of the slider of FIG. 6.
Figure 7:
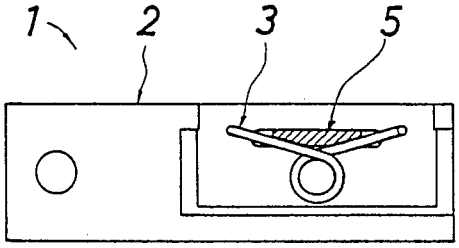
FIG. 7 is a vertical sectional front view of the main portion of the slider of FIG. 6.

As illustrated in FIGS. 1–5, the main body 2 comprises the connecting protrusion 6, the base plate 7, the projection 8, the guide grooves 9 and 10, the cavity 11, the oblong holes 12 and 13 and pin holes 14 and 15. However, the construction is not limited only to that shown in FIGS. 1–5. As shown in FIGS. 6 through FIG. 8, for instance, the cavity 11 formed in the projection 8 may be open on the top side and the front side, the oblong hole may be provided only in the base plate 7, and the pin 20 may be attached to the base plate 7, thus making the pin holes 14 and 15 unnecessary. Furthermore, the main body 2 comprises plate member 21 having upper and lower protrusions 25 to the rear thereof and superimposed on the upper and lower portions of the projection 8 to prevent the slider main body 2 and the slider knob 4 from moving vertically relative to each other while allowing the slider knob to move longitudinally relative to the main body.

Figure 9:
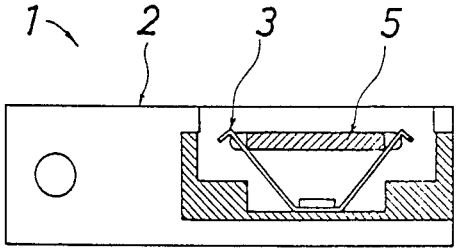
FIG. 9 is a cutaway front view of the main portion of a further embodiment of the slider.
Figure 12:
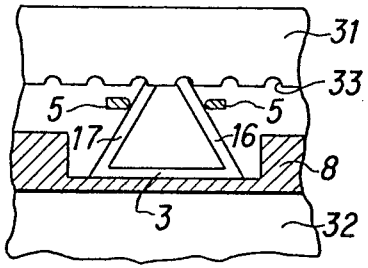
FIG. 12 is a front sectional view illustrating further embodiments of the resilient stopper and release protrusion.
Figure 13:
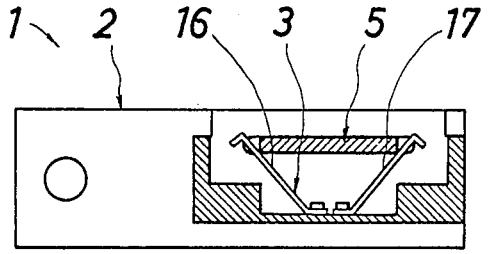
FIG. 13 is a sectional view of an embodiment wherein the stopper flaps are formed as two separate pieces; and, FIG. 14 is a sectional view of an embodiment wherein the stopper flaps are integrally formed with the slider main body.

In FIGS. 6–8, the resilient stopper 3 comprises an approximately V-shaped torsion wire spring. As shown in FIG. 9, the stopper 3 may, for instance, be an approximately V-shaped plate spring made from spring steel or synthetic resin. The tips of the plate spring are also V-shaped as shown in FIG. 9 and do not require the extensions bent to the front and rear, as required for the embodiment of FIG. 6. Although the forwardly slanting resilient flap 16 and the backwardly slanting resilient flap 17 are shown as being of one integral piece they may comprise two separate pieces as illustrated in FIG. 13. In a further embodiment, and as illustrated in FIG. 12, the resilient stopper 3 may be of an approximate C shape (a triangle shape having an opening at its top) with the forwardly slanting resilient flap 16 being placed at the rear position and the backwardly slanting resilient flap 17 at the forward position.

In FIGS. 1–5, the release protrusion 5 is positioned between the forwardly slanting resilient flap 16 and the backwardly slanting resilient flap 17 because the resilient stopper 3 is of an approximately V-shape. However, when the resilient stopper 3 is, for instance, of an approximate C-shape (a triangle having an opening at it top), the release protrusion 5 may comprise two pieces, one positioned forwardly of the backwardly slanting resilient flap 17 and another rearwardly of the forwardly slanting resilient flap 16, as illustrated in FIG. 12.

Figure 14:
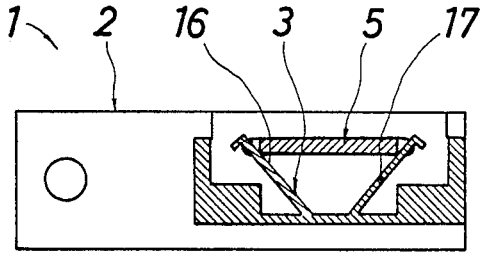

The resilient stopper 3 need not be fitted to the main body 2 with the pin 20, but may be fastened, for instance, with a screw or by means of insertion into the slider main body. When the material of construction for the resilient stopper 3 is the same as that for the slider main body 2, the resilient stopper 3 may be an integral part thereof as illustrated in FIG. 14.

The resilient stopper 3 need not be constructed so that one portion of each of the forwardly slanting resilient flaps 16 and the backwardly slanting resilient flap 17 directly touches the release protrusion 5. Instead, a portion for exclusively touching the release protrusion 5 may be provided in the forwardly slanting resilient flap 16 and the backwardly slanting resilient flap 17.

From the foregoing description it is seen that the slider comprises the slider main body, the resilient stopper, the slider knob and the release protrusion and is so constructed that the forwardly slanting resilient flap and the backwardly slanting resilient flap of the resilient stopper engage with two separated or spaced stopper dents formed in the holder so as to directly prevent the slider main body from longitudinally moving relative to the holder. The slider, therefore, can be made simple in structure and can function smoothly and flawlessly without the necessity of improving the assembly accuracy.

The slider is so constructed that the release protrusion and the slider knob are brought to the neutral position by utilizing the resilience of the resilient stopper. Therefore, for returning the slider knob to the neutral position a separate spring member is not necessary in contrast to prior art devices, thus minimizing the number of parts.

The slider is so constructed that the forwardly slanting resilient flap and backwardly slanting resilient flap of the resilient stopper engage with two spaced-apart stopper dents formed in the holder, thus firmly restraining the main slider body relative to the holder and, therefore, improving stability of the slider.

Finally, the simple structure of the slider reduces manufacturing costs and facilitates the assembly operation.

While preferred embodiments of the invention have been described in specific detail, it will be understood that various modifications and substitutions may be made in the described embodiments without departing from the spirit and scope of the invention as defined by the appended claims.

The embodiments of the invention in which an exclusive property or privilage are claimed are defined as follows:

1. A slider for a cutter knife comprising:

a slider main body which has a connecting protrusion capable of engaging with a cutter blade and is inserted together with said cutter blade into a holder for longitudinal movement therein;

a resilient stopper provided in said slider main body, said resilient stopper having a forwardly slanted resilient flap and a backwardly slanted resilient flap both provided with respective free ends which respectively engage with two spaced-apart stopper dents of a plurality of stopper dents formed in said holder so as to prevent said slider main body from longitudinally moving relative to said holder;

a slider knob provided on said slider main body, said slider knob being movable longitudinally to a neutral, forward movement or backward movement position, with the neutral position being located between the forward and backward movement positions; and, a release protrusion attached to said slider knob, said release protrusion allowing both said resilient flaps to engage with said stopper dents when said slider knob is located at the neutral position while allowing said forwardly slanted resilient flap alone to disengage from said stopper dents when said slider knob is located at the forward movement position and further allowing said backwardly slanted resilient flap to disengage from said stopper dents when said slider knob is located at the backward movement position.

2. A slider for a cutter knife as claimed in claim 1, wherein said resilient stopper is made of an approximately V-shaped torsion wire spring.

3. A slider for a cutter knife as claimed in claim 1, wherein said resilient stopper is made of an approximately V-shaped plate spring.

4. A slider for a cutter knife as claimed in claim 1, wherein said forwardly slanting resilient flap and said backwardly slanting resilient flap are of one integral piece.

5. A slider for a cutter knife as claimed in claim 1, wherein said forwardly slanting resilient flap and said backwardly slanting resilient flap of said resilient stopper are of separate pieces.

6. A slider for a cutter knife as claimed in claim 1, wherein said resilient stopper is of an approximate V-shape with said forwardly slanting resilient flap being placed at the forward position and said backwardly slanting flap at the backward position.

7. A slider for a cutter knife as claimed in claim 1, wherein said resilient stopper is of a triangle shape having an opening at its top with said forwardly slanting resilient flap being placed at the backward position and said backwardly slanting resilient flap at the forward position.

8. A slider for a cutter knife as claimed in claim 1, wherein said resilient stopper is mounted on said slider main body by means of a pin.

9. A slider for a cutter knife as claimed in claim 1, wherein said resilient stopper is fastened to said main body by means of a screw.

10. A slider for a cutter knife as claimed in claim 1, wherein said resilient stopper is fastened by means of insertion into said slider main body.

11. A slider for a cutter knife as claimed in claim 1, wherein said resilient stopper is made from the same material as said slider main body and is an integral part thereof.

12. A slider for a cutter knife as claimed in claim 1, wherein one portion of each said forwardly slanting resilient flap and said backwardly slanting resilient flap of said resilient stopper directly touches said release protrusion.

13. A slider for a cutter knife as claimed in claim 1, wherein a portion for exclusively touching said release protrusion is provided on said forwardly slanting resilient flap and said backwardly slanting resilient flap of said resilient stopper.

14. A slider for a cutter knife as claimed in claim 1, wherein said release protrusion is a one-piece structure protruding from said slider knob.

15. A slider for a cutter knife as claimed in claim 1, wherein said release protrusion comprises two spaced-apart pieces protruding from the slider knob, respectively.

16. A slider for a cutter knife as claimed in claim 1, wherein said release protrusion is positioned between said forwardly slanting resilient flap and said backwardly slanting resilient flap of said resilient stopper, said resilient stopper having an approximate V shape.

17. A slider for a cutter knife as claimed in claim 15, wherein one of the two pieces of said release protrusion is positioned in the front of said backwardly slanting resilient flap and the other in the rear of said forwardly slanting resilient flap and said resilient stopper has a triangle shape having an opening at its top.

18. A slider for a cutter knife comprising:

a slider main body which has a connecting protrusion capable of engaging with a cutter blade and is inserted together with said cutter blade into a holder for longitudinal movement therein;

a resilient stopper provided in said slider main body, said resilient stopper having a forwardly slanted resilient flap and a backwardly slanted resilient flap both provided with free ends which respectively engage with two spaced-apart stopper dents of a plurality of stopper dents formed in said holder so as to prevent said slider main body from longitudinally moving relative to said holder;

a slider knob provided on said slider main body, said slider knob being movable longitudinally to a neutral, forward movement or backward movement position, with the neutral position being located between the forward and backward movement positions; and, a release protrusion attached to and movable with said slider knob, said release protrusion allowing both said resilient flaps to engage with said stopper dents when said slider knob is located at the neutral position, said release protrusion pressing against said forwardly slanted resilient flap in the direction of said longitudinal movement to disengage said forwardly slanted resilient flap from said stopper dents when said slider knob is located at the forward movement position and pressing against said backwardly slanted resilient flap in the direction of said longitudinal movement from said stopper dents when said slider knob is located at the backward movement position.

19. A slider for a cutter knife comprising:

a slider main body which has a connecting protrusion capable of engaging with a cutter blade and is inserted together with said cutter blade into a holder for longitudinal movement therein;

a resilient stopper provided in said slider main body, said resilient stopper having a forwardly slanted resilient flap and a backwardly slanted resilient flap both provided with free ends which respectively engage with two spaced-apart stopper dents of a plurality of stopper dents formed in said holder so as to prevent said slider main body from longitudinally moving relative to said holder;

a slider knob provided on said slider main body, said slider knob being movable longitudinally to a neutral, forward movement or backward movement position, with the neutral position being located between the forward and backward movement positions; and, a release protrusion attached to said slider knob, and movable only longitudinally relative to said slider main body, said release protrusion allowing both said resilient flaps to engage with said stopper dents when said slider knob is located at the neutral position while allowing said forwardly slanted resilient flap alone to disengage from said stopper dents when said slider knob is located at the forward movement position and further allowing said backwardly slanted resilient flap to disengage from said stopper dents when said slider knob is located at the backward movement position.

* * * * *